US011624136B1

(12) United States Patent
King

(10) Patent No.: US 11,624,136 B1
(45) Date of Patent: Apr. 11, 2023

(54) SERGER SEAM HOOK FOR TUCKING THREAD TAILS

(71) Applicant: Feather W. King, Medford, OR (US)

(72) Inventor: Feather W. King, Medford, OR (US)

( * ) Notice: Subject to any disclaimer, the term of this patent is extended or adjusted under 35 U.S.C. 154(b) by 27 days.

(21) Appl. No.: 17/523,709

(22) Filed: Nov. 10, 2021

Related U.S. Application Data

(62) Division of application No. 15/990,431, filed on May 25, 2018, now abandoned.

(60) Provisional application No. 62/511,816, filed on May 26, 2017.

(51) Int. Cl.
*D05B 85/00* (2006.01)

(52) U.S. Cl.
CPC ..... *D05B 85/006* (2013.01); *D05D 2305/60* (2013.01)

(58) Field of Classification Search
CPC ..... D05B 85/006; D05B 89/00; D05B 91/00; D05B 95/00; D05D 2305/60
See application file for complete search history.

(56) References Cited

U.S. PATENT DOCUMENTS 593,461 A * 11/1897 Darmody ..... A01G 23/099 30/294
2,290,432 A 7/1942 Hokstad
3,220,221 A 11/1965 Sheeler
4,790,254 A 12/1988 Vornholt

OTHER PUBLICATIONS

Description and view of Dritz Knit Picker 82403, print from dritz.com website, copyright 2020, Prym Consumer USA Inc., 2 pages.

* cited by examiner

*Primary Examiner* — Nathan E Durham
(74) *Attorney, Agent, or Firm* — Thomas M. Freiburger

(57) ABSTRACT

A small, flat and elongated tool is provided, with a hook at its distal end, for inserting between stitches and sliding under the threads of a serged sewing seam. The tool, held between the thumb and finger of a user, is effective to grab the tail threads from the serger seam and to pull them back into the seam.

18 Claims, 2 Drawing Sheets

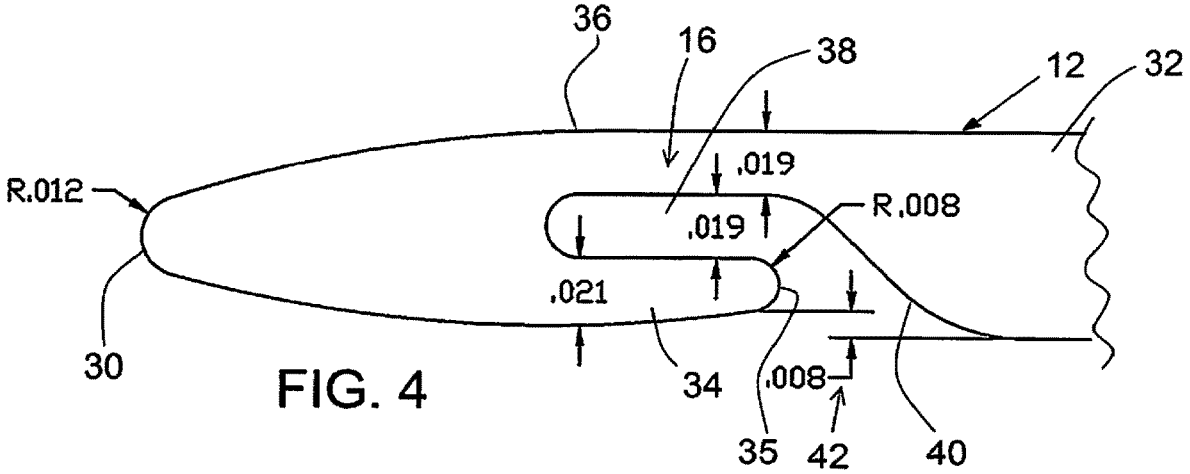
FIG. 4
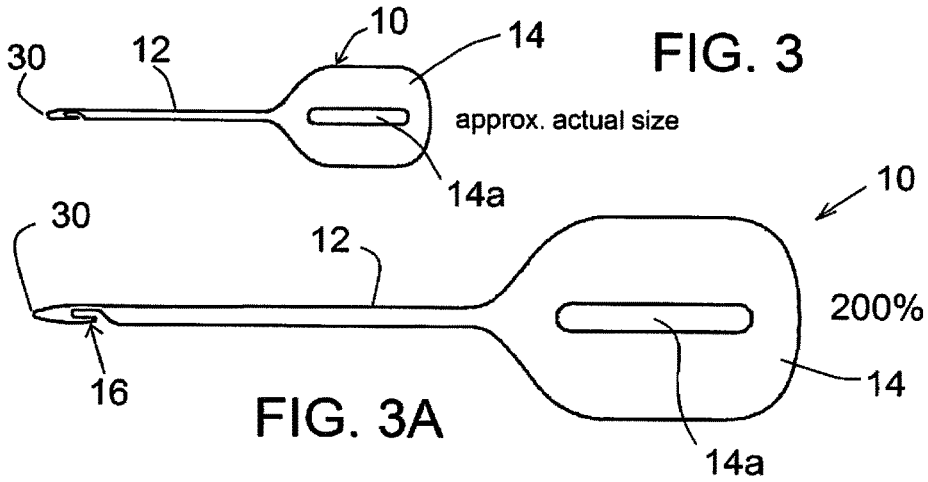
FIG. 3
FIG. 3A

SERGER SEAM HOOK FOR TUCKING THREAD TAILS

This application is a division of application Ser. No. 15/990,431 filed May 25, 2018, which claimed benefit of provisional application No. 62/511,816, filed May 26, 2017.

BACKGROUND OF THE INVENTION

The invention concerns sewing accessories, and in particular a hand tool for use in tucking tail threads at the end of a serger seam made by a serger sewing machine.

Serged sewing seams produce a tail of threads at the end of a line of stitching, normally including three, four or five threads. Securing such a line of stitching to prevent the threads becoming loose has been problematic and time consuming, and different techniques have been used to do this. For example, fabric glues can be used to stiffen the threads and make it harder for them to unravel, but drying time is required for the glue to set. The use of an upholstery needle is also an alternative, but requires twisting the multiple threads of the serged seam to make a tight thick thread that can be threaded through the eye of the needle and then pulled back into the seam itself to secure it. This operation also requires removing the thread tails from the needle.

What has been needed is a quick and easy way to bring the loose tail threads back into the seam, to lock them in place.

SUMMARY OF THE INVENTION

The invention provides an efficient solution in the form of a small tool with a hooked end. The design of the tool resembles to some extent a crochet hook, but it works differently. The tool is tiny and very flat so that it can slide under the threads of a serged sewing seam. The hook at the distal end works to grab the tail threads and to pull them back into the seam to hold them in place. First, the user slides the hook under the threads that overlap the edges of fabric of a serged seam, inserting the device at a position about ½ to ¾ of an inch from the end of the seam. The hooked end is extended out the seam end, then is used to hook the ending tails of all threads that make up the tail of the serged seam. These can amount to 3, 4 or 5 threads. Prior to hooking the thread tails, the user will have already cut them to a length of about 2 inches so that they are a convenient length to go into the hook slot of the device and be pulled back in under the seam threads.

The hook is unique in that it has a nearly closed and protected opening, and is offset and narrower than the width of the shaft of the device. In addition, the hook structure has an inward curve so that the threads of the serged seam slide right past the hook opening as one slides the blade in under the overlapping threads. Also, an angled rise up to a hump that follows the hook opening serves to guide the overlapping seam threads up and away from the hook opening. This hump also forces the overlapping seam threads to pass over the hook opening when the thread tails are being drawn backward in under the seam as the hook is pulled back out.

The serger seam hook of the invention resembles a crochet hook only in that it has a distal hook at the end of an elongated shaft. The thin flatness of the device makes it very different, and the shape of the distal end of the blade or shaft, with its rounded offset curve going into the hook slot, will direct the threads past the opening and up onto the hump as the blade is fed into the seam. This shape also serves to keep the end of the blade away from any threads at all, if the blade is slightly rotated with the hook side down toward the fabric going in or out so that the hook is away from the seam threads and the hump elevates the offset narrower portion of the blade with the hook opening, further removing it from catching any threads. Crochet hooks do not have the tight tolerances of this hook nor the thinness and flatness; they are not necessary for crocheting since yarn stretches and can make a large hole to pull through, whereas fabric and a sewn seam are rigid and very small and the hook must slide into a tightly sewn area. Crochet hooks have no protection against snagging when pulled back and could not be used in a stitched seam.

The tool can have a molded plastic handle attached to a steel shaft/hook, or it can be all steel including the handle, preferably powder coated to provide at least two colors (e.g. light and dark) for contrast with particular colors of serger seam threads. It could also be unitary molded plastic, although steel is preferred for the shaft and hook. The function is the same either way.

A slot preferably is provided in the metal handle, for allowing the flesh of the fingers (thumb and forefinger) to touch each other, preventing any slipping of the tool while it is held for use.

An object of the invention is to make easy and efficient the task of tucking away tail threads at the end of a serge seam, using a small hand tool. These and other objects, advantages and features of the invention will be apparent from the following description of a preferred embodiment, considered along with the accompanying drawings.

DESCRIPTION OF THE DRAWINGS

FIG. 3 is a plan view showing the tool of the invention.

FIG. 3A is a detail view showing the tool.

FIG. 4 is an enlarged view showing a portion of the distal end of the tool.

DESCRIPTION OF PREFERRED EMBODIMENTS

Figure 1:
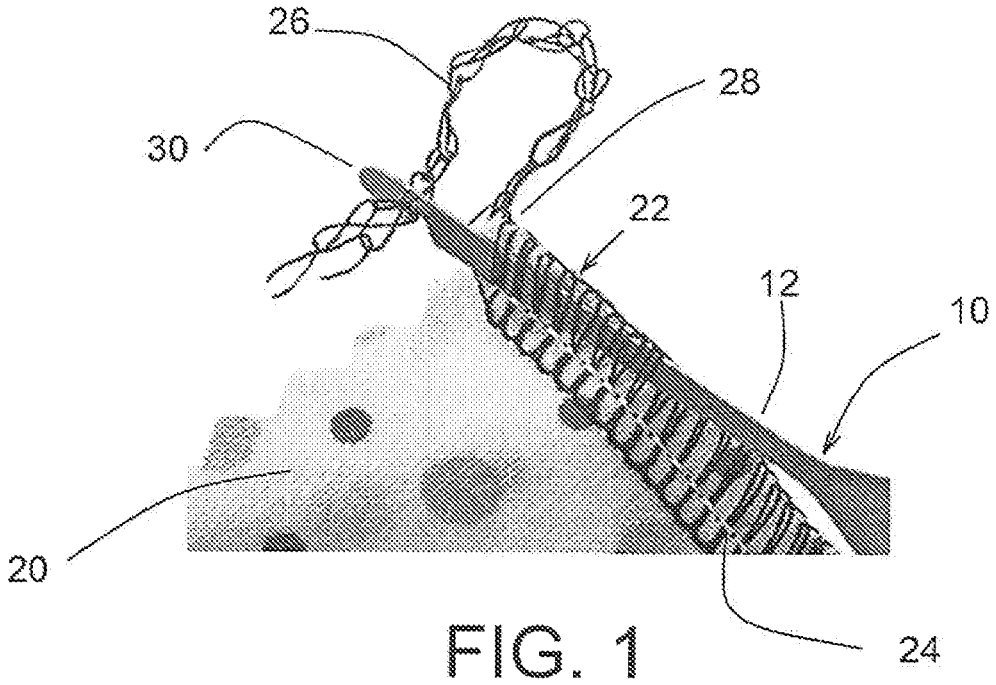
FIG. 1 is a schematic perspective view showing a serger seam hook tool of the invention being inserted through serger seam stitches.

The drawings show the serger seam hook device 10 in a preferred form. Its overall length can be about 2¼ inches, including the shaft or blade 12 and the handle 14, as shown in FIGS. 3 and 3A. A hook 16 is formed at the distal end of the shaft or blade, as further discussed below. The handle tab 14 preferably has an open slot 14*a* to aid in gripping the thin tool, which may be about the thickness of an erasing shield.

Figure 2:
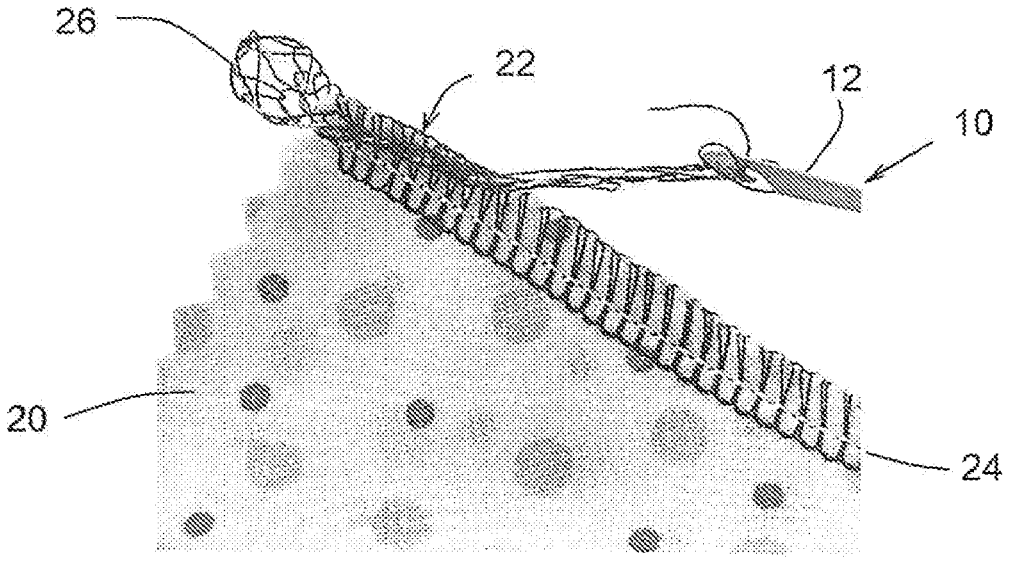
FIG. 2 is a view similar to FIG. 1 but showing the tool pulling tail stitches back through the stitched seam.

FIGS. 1 and 2 show the serger seam hook tool 10 in use. In FIG. 1 a piece of fabric 20 has been stitched with a serger seam 22, by a serger sewing machine. A safety stitch of the serger seam is shown at 24. The portion of the serger stitch shown to the upper right of the safety stitch 24 in FIG. 1 is quite narrow and tightly formed. For this purpose, the blade 12 of the serger seam hook device 10 is quite narrow. Its width can be about 1/16 inch, and it is flat and very thin, for example about 0.016 inch in thickness. It could be thicker, e.g. 0.020 to 0.030 inch, but thinner is better for insertion into tight seams.

As shown in FIG. 1, tail threads 26 extend at the end of the line of the serger stitch seam 22. These threads need to be confined and restrained from hanging freely and unraveling the seam.

FIG. 1 shows that the tool 10 is inserted into the stitching of the serger seam, preferably at a position that is back about ½ inch to ¾ inch or more from the end 28 of the seam. The user slides the distal tip 30 under these stitches and against the fabric surface, to extend the hook 16 out from the end of the stitched seam as shown. The threads (3, 4 or 5) are then engaged in the hook 16 of the tool, as shown.

FIG. 2 shows pulling back of the tool 10 to pull the several tail threads back into the seam. When they have been fully pulled back into the stitching, i.e. between the stitches and the fabric, the remainder of the tail threads extending out from between the stitches can be snipped off with scissors.

As discussed above, the serger seam hook tool 10 is extremely thin and flat, and with a narrow shaft or blade 12, for the purpose described above. An example of preferred dimensions is as follows (with preferred ranges in parentheses):

Overall length: 2.25" (or 2" to 3")
Width of tab handle 14: 0.625" (0.35" to 0.8")
Slot size 14*a* in handle: 0.075"×0.5625" (or as desired)
Blade/shaft 12 width: 0.0625" (0.05" to 0.09", pref.<0.07")
Blade/shaft 12 length: 1.3" (0.75" to 2" or greater)
Thickness of blade/shaft: 0.016" (0.01" to 0.03")
Hook slot channel width: 0.019"-0.020" (0.018" to 0.024")
Length of hook slot: 0.062" (at least 0.045")
Hook slot opening (at mouth/exit): 0.050" (0.04" to 0.07")
Offset in shaft width at mouth: 0.008" (0.006" to 0.010")

The detail view of FIG. 4, which is an enlarged view of the distal end portion of the tool shaft or blade 12, shows preferred geometry of the slot 16. Dimensions and radii are shown, all in inches. The width of the shaft 12 throughout most of its length, as at 32, preferably is about 1/16 inch, i.e. 0.0625 inch. This narrows by 0.008 inch at the mouth of the hook, as shown in FIG. 4. Distal of that point, the hook end portion or "thumb" 34 widens out to a width of about 0.021 inch at its base end, from about 0.016 inch at the radiused tip 35 of that hook end. Thus, the overall width of the shaft at the base of that hook end, i.e. at the location 36 in FIG. 4, is about 0.059, still less than the 0.0625 width in the main part of the shaft (at 32).

The hook's channel 38 is narrow, shown as being 0.019 inch, and this remains narrow as it curves toward the opening. The overall geometry with the forward (distal) end of the tool being narrower and especially at the end of the thumb 35, creates a hump as referred to above, at the location 40 in the drawing. As explained above, this hump or shoulder helps deflect seam threads from the hook opening, especially as the device is pulled back to draw tail threads into the seam. The difference in width of the shaft at the two sides (distal and proximal) of the hook opening 42, as well as the inward angle of the outer surface of the hook end piece or thumb 34, are important features that enable the tool easily to be pulled back through the serger seam stitches without snagging on the seam stitches themselves. The radius at the tip 35 of the hook end piece (thumb) 34 is also important in this regard. Note that the hump at 40 could be of short length along the shaft 32, just a protrusion of increased width, rather than being continuous through the shaft 32 at that increased width.

As shown, the distal tip 30 of the shaft or blade 12 also has a radius, shown here as 0.012 inch, and the width of the shaft tapers inwardly toward that radiused tip.

As seen in the drawings, particularly FIGS. 3A and 4, the geometry discussed above effectively offsets the distal portion of the device's shaft 12, i.e. the portion including the hook end or thumb 34 and to the distal tip 30, from the wider main portion of the shaft (or from a hump at 40 regardless of shaft width up toward the handle).

On pulling the serger seam tool 10 back to draw the thread tails into the seam, the user can slightly rotate the tool, turning the hook opening and hook thumb 34 down toward the fabric, thus making it even easier to prevent the hook from catching any of the looped threads that overlap the fabric edge. The narrower width of the end part of the tool with the hook also helps avoid catching the hook on the fabric as it is withdrawn, since this holds the hook slightly above the fabric, held away by the greater width of the shaft in the main part 32.

The dimensions of the invention can vary, but small size sufficient to insert between stitches of a serger seam and to engage and pull tail threads back into the seam is essential. As noted above, the thickness can be somewhat greater if desired, but preferably not greater than about 0.02 to 0.03 inch. It could be somewhat thinner, e.g. about the thickness of an erasing shield, provided the material is sufficiently strong. The width of the tool, at the shaft 32, is described in the preferred embodiment above as 1/16". This could be narrower (e.g. 0.05") or slightly greater, but it must be narrow enough to be slid through a serger seam. For example, the width could be as great as 3/32" for some serger seams (i.e. 0.094"), but the width is preferably less than 0.09", more preferably less than 0.08" and most preferably less than 0.07". The tool could be of greater length if desired. The hook slot could be deeper, but this is normally not needed. The width of the slot could be somewhat less, e.g. 0.018", or even down to 0.015", and the thumb at its widest could be 0.015" to 0.016". However, manufacturing tolerances, preferably by steel stamping, and the need to engage multiple thread tails limit how small the hook slot can be made, and the thumb needs sufficient strength so as not to easily damage. The handle could be larger and the shaft longer, but the farther the handle from the hook, the less control afforded.

The term "about" in reference to the dimensions herein should be understood as meaning within 10%, plus or minus.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A method for tucking tail threads of a serger seam applied to a fabric back into the seam to prevent unraveling of serger seam stitches of the seam, comprising:

providing a thin, flat hook device having a handle for gripping by a hand of a user, a shaft attached to and distal of the handle and a hook near a distal end of the shaft remote from the handle, the hook being formed as an opening into an edge of the shaft, inserting the distal end of the shaft of the hook device between stitches of the serger seam, at a selected distance back from an end of the serger seam from which the tail threads extend, and sliding the shaft in a distal direction under the serger seam stitches until the distal end and the hook of the device extend out said end of the seam, gripping the tail threads with the hook of the hook device, and pulling the device back proximally such that the tail threads are drawn into the serger seam beneath the stitching threads until the tail threads are fully pulled into the seam and the device has been pulled back out of the seam.

2. The method of claim 1, further including, while pulling the hook device back, rotating the hook device essentially about a long axis of the shaft to turn the hook slightly downwardly against the fabric within the serger seam, thereby helping avoid snagging of any serger seam threads as the hook device is pulled back.

3. The method of claim 1, wherein the hook includes a mouth leading to a slot channel, a hook thumb forming a side of the slot channel, and a hook point on an end of the hook thumb, the hook point being directed proximally, and the hook thumb being offset inwardly on the shaft immediately distal of the hook mouth, such that the hook when retracted through the serger seam will tend not to snag on stitch threads of the serger seam.

4. The method of claim 3, wherein the slot channel of the hook has a width in a range of about 0.019" to 0.020".

5. The method of claim 4, wherein the hook slot channel has a length of about 0.06".

6. The method of claim 3, wherein the shaft has a width at the end of the hook thumb that is less than the shaft's width at a more distal point on the shaft, approximately at the inner end of the hook slot channel.

7. The method of claim 6, wherein the width at said more distal point is in a range of about 0.003" to 0.005" wider than the shaft's width at the hook thumb point.

8. The method of claim 3, wherein the hook thumb is offset inwardly on the shaft by at least about 0.006" immediately distal of the hook mouth.

9. The method of claim 3, wherein the hook point has a radius of about 0.008".

10. The method of claim 1, further including cutting off a portion of the tail threads extending out between stitches of the serger seam.

11. The method of claim 1, wherein the shaft has a thickness in a range of about 0.01 inch to 0.02 inch.

12. The method of claim 1, wherein the shaft has a width no greater than about 3/32".

13. The method of claim 1, wherein the hook opening, at a mouth or opening of the hook opening, has a width in a range of about 0.04" to 0.07".

14. The method of claim 1, wherein the hook device has a proximal end which is formed into said handle, of greater width than the shaft.

15. The method of claim 1, wherein the shaft has a width no greater than 0.1 inch.

16. The method of claim 1, wherein the shaft has a width no greater than 0.08 inch.

17. The method of claim 1, wherein the shaft has a width no greater than 0.0625 inch.

18. The hand tool of claim 1, wherein the shaft has a thickness of about 0.016".

* * * * *